United States Patent [19]

Bäumel

[11] 4,000,984

[45] Jan. 4, 1977

[54] HIGH SILICON-CONTAINING AUSTENITIC-IRON-CHROMIUM-NICKEL ALLOYS

[75] Inventor: Anton Bäumel, Meerbusch, Germany

[73] Assignee: Gebr. Bohler & Co., A.G., Wein, Austria

[22] Filed: July 14, 1975

[21] Appl. No.: 595,416

Related U.S. Application Data

[63] Continuation-in-part of Ser. Nos. 479,140, June 13, 1974, abandoned, Ser. No. 479,550, June 14, 1974, abandoned, and Ser. No. 479,551, June 14, 1974, abandoned.

[30] Foreign Application Priority Data

June 19, 1974 Germany ..... 2331098

[52] U.S. Cl. ..... 29/183; 75/128 A; 75/128 C; 75/128 G; 75/128 N

[51] Int. Cl.[2] ..... C22C 38/26; C22C 38/34

[58] Field of Search ..... 148/38; 75/128 C, 128 G, 75/128 N, 128 A; 29/183

[56] References Cited

UNITED STATES PATENTS

| | | | |
|---|---|---|---|
| 2,506,518 | 5/1950 | Norris | 75/128 G |
| 2,920,954 | 1/1960 | Mott | 75/128 G |
| 3,592,634 | 7/1971 | Denhard, Jr. et al. | 75/128 G X |
| 3,615,368 | 10/1971 | Baumel | 75/128 C |

*Primary Examiner*—Arthur J. Steiner
*Attorney, Agent, or Firm*—Holman & Stern

[57] ABSTRACT

Construction and machine parts manufactured from high-silicon-containing, austenitic iron-chromium-nickel alloys containing 0.01–0.25% C, 3.5–5.0% Si, 0.0–2.0% Mn, 17.0–20.0% Cr, 14.0–18.0% Ni, 0.0–0.2% N, 1.0–2.0% Nb, with the remainder being iron and unavoidable impurities. The parts are useful in air combustion and carburizng atmospheres at temperatures above 800° C or in a nitriding atmosphere at temperatures above 400° C.

4 Claims, No Drawings

HIGH SILICON-CONTAINING AUSTENITIC-IRON-CHROMIUM-NICKEL ALLOYS

CROSS REFERENCE TO RELATED APPLICATIONS

This application is a continuation-in-part application of U.S. applications Ser. Nos. 479,140, filed June 13, 1974 479,550 filed June 14, 1974 and 479,551 filed June 14, 1974 all now abandoned.

BACKGROUND OF THE INVENTION

The instant invention concerns austenitic iron-chromium-nickel alloys which are suitable for manufacturing machine and construction parts required to resist air oxidation and carburization when exposed to temperatures above 800° C and to resist nitriding at temperatures above 400° C.

The common austenitic chromium-nickel steels and cast alloys subjected to air combustion atmospheres, which develop as a result of the combustion of various heating gases with air, are subjected to air oxidation and are not sufficiently heat-resistant.

The heat-resistant steels which are presently utilized for operational temperatures of approximately 800° C may be austenitic chromium-nickel steels with a silicon content of about 2.5% and a chromium content of about 25%, whereby the silicon should support the effect of the chromium. Higher percentages of these alloying elements, namely the chromium and the silicon, have however the disadvantage that excessively high contents of the same lead to embrittlement and must therefore be avoided.

Austenitic chromium-nickel alloys with higher silicon contents, such as about 4%, have formerly obtained importance only as acid-resistant base materials.

Likewise, with regard to carburization at temperatures above 700° C, the prior art austenitic chromium-nickel steels and cast alloys show obvious tendencies for carburization in a caburizing atmosphere.

The extent of carburization generally increases with increasing temperature. The carbon which is diffusing in the steel separates owing to exceeding of the solubility limit as chromium carbides, preferably at the grain boundaries. In this manner, chromium is taken from the matrix of the steel and the oxidation resistance thereof is reduced. The ductility of the steels and alloys is reduced with increasing precipitation of the brittle and hard obvious carbides. At temperature-change stress, to which many high-temperature parts are subjected, cracks develop after a relatively short period of use. These cracks result in an early failure of the construction parts.

These events are qualitatively the same for rolled and forged steels as well as for casting steels.

In order to prevent the premature failure of austenitic chromium-nickel steels and alloys during use in carburizing atmospheres, there were used in the prior art steels and alloys having a higher nickel content. These steels and alloys were derived from two basic types having 25% Cr, 20% Ni and 35% Ni, 20% Cr. The chromium content of at least 20% guarantees an oxidation resistance which is sufficient for most purposes, while the carburization resistance is greatly improved due to the nickel content of at least 20%.

With respect to nitriding, the common austenitic chromium-nickel steels and casting alloys, at temperatures above approximately 400° C in some nitrogenous atmospheres, for example in an atmosphere of ammonia fission gas, show a noticable tendency for nitriding. Also in the production of melamine, nitrogen is separated which produces nitriding on construction sections. The extent of nitriding generally increases with increasing temperature. A constantly growing nitride layer may develop on the surface; however, there may also be precipitated coarse chromium nitrides at the grain boundaries or inside of the grains, especially at higher temperatures. With an increasingly separated amount of the brittle and hard chromium nitrides, the oxidation resistance of the matrix due to depletion of the chromium and additionally the ductility of the steels are reduced. Most of all, stresses due to changes in temperature will result in the development of cracks and the failure of the construction parts after a relatively short time of operation.

In order to prevent the premature failure of austenitic chromium-nickel steels in nitriding atmospheres, steels with a higher nickel content, especially of the two basic types having 24% Cr, 20% Ni, and 35% Ni, 20% Cr, were utilized. The steels had a silicon content of up to about 2.5%.

THE INVENTION

It has now been found that austenitic iron-chromium-nickel alloys containing 0.01–0.25% C, 3.5–5.0% Si, 0.0–2.0% Mn, 17.0–20.0% Cr, 14.0–18.0% Ni, 0.0–0.2% N and 1.0–2.0% Nb with the remainder being iron and unavoidable impurities are especially suitable as construction and machine parts for use in air combustion and carburizing atmospheres at temperatures above 800° C, or in nitriding atmospheres at temperatures above 400° C.

On the basis of extensive research results, the special characteristics are due in part to the high silicon content. Contrary to earlier expectations, the increase of the silicon content will not improve the high-temperature embrittlement characteristics as extensively as would an increase of the chromium content at about the same measure, insofar as the adaptation of the remaining elements will guarantee an austenitic structure.

Construction parts which are utilized under high temperatures, such as, for instance, furnace grills, rollers of continuous heating furnaces, reaction pipes in the petro-chemical industry and the like, are almost always also subjected to mechanical stresses. In order so that they will not deform unacceptably, whereby their functionality would be adversely influenced, raw materials for such constructions must, in addition to their high-temperature stability, simultaneously always have a high heat-resistance. In accordance with the invention, this is obtained in that the proposed alloy has a niobium content of 1.0–2.0%. Within these limits under a generally sufficient heat-stability, there will not develop further difficulties from a manufacturing or a processing-technical point of view. The following examples will further illustrate the practice of the invention.

EXAMPLE 1

A steel comprising 0.033% C, 3.95% Si, 0.72% Mn, 18.2% Cr, 14.9% Ni, 0.054% N and 1.47% Nb was utilized as a cover-metal sheet in furnaces heated with earth-gas for the solution-treatment of stainless steels. The working temperature varied between 1050° and 1120° C. The sheets were directly subjected to the flames. The 2.5mm thick metal sheets resisted this stress for a duration of over 1 year, with a nominal amount of oxidation.

Comparatively, a steel having 0.15% C, 1.25% Si, 0.8% Mn, 24.3% Cr, and 21.6% Ni, the remainder being iron and unavoidable impurities, was utilized simultaneously, and under the identical time period, conditions clearly showed strong oxidation. The sections were also substantially more strongly deformed, which is clearly due to a lower heat-resistance.

EXAMPLE 2

Another steel alloy with 0.05% C, 4.92% Si, 1.45% Mn, 19.4% Cr, 16.2% Ni, 0.165% N and 1.25% Nb was utilized for mounting into a carburization plant for gear-parts for the automobile industry. For this purpose of utilization, there was earlier utilized a raw material with a high nickel content having the following composition: 0.11% C, 1.65% Si, 0.05% Mn, 16.7% Cr, and 34.8% Ni. While my inventive steel was in use for a duration of ca. two years, the above did show the first damages after four months and after seven months became unusable due to crack formation as a result of carburization and selective oxidation of the matrix. The conditions were: temperature ca. 960° C, isobutyl alcohol used as carburization agent. The temperature was changed twice per day between 960° C and room temperature.

EXAMPLE 3

A further steel alloy having 0.05% C, 4.48% Si, 1.12% Mn, 18.45% Cr, 15.2% Ni, 0.11% N and 1.82% Nb was processed into pipes with longitudinally-welded seams, the pipes being placed into a throughflow-wire-furnace which was operated with fission gas ($2NH_3 \rightleftarrows N_2+3H_2$). The operating temperature was about 1100° C. By inserting 18/8 Cr-Ni-steel-pipes for this purpose, a change in the cycle of about 14 days became necessary. Pipes from the abovementioned novel alloy could be used for about 6 months. Under these circumstances, also the substantially higher heat-stability of the novel alloy could be noted since the pipes in this case deformed only very little. Fission gas represents an atmosphere which produces strong nitriding.

Pipes from the same alloy were also used in the production of Melamine-resin. In this case, there developed at a temperature of about 450° C a strong nitriding in the normal austenitic stainless steels. The pipes made from the inventive steel produced an increase in durability of at least five times as much.

What is claimed is:

1. In construction parts, such as furnace grills, rollers of continuous heating furnaces and reaction pipes in the petro-chemical industry, operating at temperatures above 800° C in carburizing or air combustion atmospheres or at temperatures above 400° C in a nitriding atmosphere, the improvement being that said construction parts are manufactured from a high silicon-containing, austenitic iron-chromium-nickel alloy consisting of 0.01–0.25% C, 3.5–5.0% Si, 0.0–2.0% Mn, 17.0–20.0% Cr, 14.0–18.0% Ni, 0.0–0.2% N, 1.0–2.0% Nb with the remainder being iron and unavoidable impurities.

2. The construction and machine parts of claim 1, wherein the high silicon-containing, austenitic iron-chromium-nickel alloy consists of 0.033% C, 3.95% Si, 0.72% Mn, 18.2% Cr, 14.9% Ni, 0.054% N, 1.47% Nb with the remainder being iron and unavoidable impurities.

3. The construction and machine parts of claim 1, wherein the high silicon-containing, austenitic iron-chromium-nickel alloy consists of 0.05% C, 4.92% Si, 1.45% Mn, 19.4% Cr, 16.2% Ni, 0.165% N, 1.25% Nb with the remainder being iron and unavoidable impurities.

4. The construction and machine parts of claim 1, wherein the high silicon-containing, austenitic iron-chromium-nickel alloy consists of 0.05% C, 4.48% Si, 1.12% Mn, 18.45% Cr, 15.2% Ni, 0.11% N, 1.82% Nb with the remainder being iron and unavoidable impurities.

* * * * *